US008141302B2

(12) United States Patent
Desotell et al.

(10) Patent No.: US 8,141,302 B2
(45) Date of Patent: Mar. 27, 2012

(54) MOTORIZED ROTATING GUTTER

(75) Inventors: Ronald J. Desotell, Green Bay, WI (US); Gerald D. Leisgang, Green Bay, WI (US); William D. Leisgang, Green Bay, WI (US)

(73) Assignee: RRTK Enterprises, Inc., Green Bay, WI (US)

( * ) Notice: Subject to any disclaimer, the term of this patent is extended or adjusted under 35 U.S.C. 154(b) by 268 days.

(21) Appl. No.: 12/417,055

(22) Filed: Apr. 2, 2009

(65) Prior Publication Data

US 2009/0249702 A1 Oct. 8, 2009

Related U.S. Application Data

(63) Continuation-in-part of application No. 12/062,172, filed on Apr. 3, 2008.

(51) Int. Cl.
*E04D 13/00* (2006.01)

(52) U.S. Cl. ..... 52/11

(58) Field of Classification Search ..... 52/11–16, 52/58, 95; 248/48.1; 405/119
See application file for complete search history.

(56) References Cited

U.S. PATENT DOCUMENTS

| | | | | | |
|---|---|---|---|---|---|
| 510,515 | A | | 12/1893 | McKenney | |
| 4,072,285 | A | | 2/1978 | Greenwood | |
| 4,117,635 | A | * | 10/1978 | Nelson | 52/11 |
| 4,309,792 | A | | 1/1982 | Faye | |
| 4,311,292 | A | | 1/1982 | Deason | |
| 4,413,449 | A | * | 11/1983 | Faye | 52/16 |
| 4,669,232 | A | * | 6/1987 | Wyatt | 52/11 |
| 4,696,131 | A | | 9/1987 | Schreffler | |
| 4,709,516 | A | | 12/1987 | Gleaves | |
| 4,745,657 | A | * | 5/1988 | Faye | 16/226 |
| 4,837,987 | A | | 6/1989 | Fender | |
| 5,274,965 | A | * | 1/1994 | Jackson | 52/11 |
| 5,357,719 | A | * | 10/1994 | Lewis | 52/11 |
| 5,649,681 | A | | 7/1997 | Faye | |
| 6,233,876 | B1 | | 5/2001 | Obidniak | |
| 6,240,679 | B1 | | 6/2001 | Smalara | |
| 6,854,692 | B1 | | 2/2005 | Winkel | |
| 7,152,376 | B2 | | 12/2006 | Wyatt | |
| 2003/0033756 | A1 | | 2/2003 | Adams et al. | |

OTHER PUBLICATIONS

Flip It—Gutter Cleaning System, available at: http://www.flipitindustries.com.au/index.php?option=com_content&task=view&id=18&Itemid=53, Feb. 26, 2008.

Flip Clean Gutter System, available at: http://flipgutters.com/, http://flipcleanguttersystems.com/, and http://www.flipgutters.com/about1.html, 2005.

* cited by examiner

*Primary Examiner* — Eileen D Lillis
*Assistant Examiner* — Andrew Triggs
(74) *Attorney, Agent, or Firm* — Boyle Fredrickson, S.C.

(57) ABSTRACT

A gutter dumping assembly is actuatable to rotate a gutter from an initial, upright position to a downwardly-facing dumped position in order to dump debris from the gutter. The actuator is coupled to the gutter support by a flexible structure so that, after the actuator positively forces the gutter to an over-center position, the gutter falls to a dumped position under only the force of gravity. The gutter is supported by a number of spaced brackets, each of which includes an upper leg that is inclined downwardly and forwardly from the rear of the bracket so as to be hidden from view and to channel rainwater falling into the bracket into the gutter as opposed to against the building or outside of the gutter.

17 Claims, 10 Drawing Sheets

MOTORIZED ROTATING GUTTER

CROSS REFERENCE TO RELATED APPLICATION

This application is a continuation-in-part application of presently co-pending U.S. application Ser. No. 12/062,172, filed Apr. 3, 2008, and entitled "Motorized Rotating Gutter," the entirety of which is incorporated herein by reference in its entirety.

BACKGROUND OF THE INVENTION

1. Field of the Invention

The invention generally relates to gutters and gutter assemblies for houses and commercial buildings. More particularly, the invention relates to a motorized gutter dumping assembly configured to rotate a gutter from an initial upright position to a dumped position to clear the gutter of collected debris such as leaves, debris, mud and the like.

2. Discussion of the Related Art

Gutter systems for use with dwellings or other such buildings are used to channel water flowing off of a roof. Such systems generally comprise horizontal gutters for receiving the water, brackets for securing the gutters to the dwelling, and a downspout for channeling collected water from the gutters to a drainage system leading away from the dwelling to a storm sewer or other discharge area.

Over the course of time, such gutters commonly become obstructed by the accumulation of debris such as leaves, twigs, snow, ice, and the like. Unless such debris is periodically removed, water that is normally easily drained by way of the downspout will either overflow or be prevented from flowing into the gutter. In either case, the water will often flow down the side of the dwelling and cause significant structural damage and the collection and growth of mildew. Further, water which is prevented from flowing down the roof and into the gutter will often accumulate on the roof and leak therethrough, causing damage to the inside of the dwelling.

Gutters may be manually cleaned by climbing onto the roof of the dwelling and removing accumulated debris by hand or by use of a hose or a manual tool such as a rake. However, this method is quite time consuming, strenuous, and potentially dangerous.

Accordingly, a number of methods of preventing the collection of debris or removing collected debris are known. For example, a commonly used method for preventing the build up of debris utilizes a screen or guard designed to overlie the opening of the gutter. However, while such systems prevent the collection of debris in the gutters, they tend to clog and make the cleaning of the gutter substantially more difficult.

In order to overcome the various disadvantages associated with the aforementioned methods of preventing debris collection or removing collected debris, rotatable gutter systems have been designed to aid in the removal of collected debris. Such systems typically rotate the gutter from an initial, upright position, to a downwardly-facing, dumped position to cause any collected debris to fall to the ground under the force of gravity or to allow for easier access to the gutter such that the debris may be more easily cleaned out by hand or with a tool such as a hose or rake. Typically, however, such gutter systems require custom-built gutter assemblies or relatively complicated pivoting mechanisms. The systems are dumped by complex and relatively unreliable chain driven arrangement. Such systems are typically quite conspicuous and therefore detract from the appearance of the dwelling. In addition, such systems generally cannot be used on relatively flat roofs.

The need therefore exists to provide gutter dumping assembly that is relatively simple to maintain and is robust enough to withstand the rigors associated with operation of such systems. The need also exists for a gutter dumping assembly that can be quickly and efficiently assembled and maintained. Further, the need also exists for a gutter dumping assembly that may be installed on existing gutters.

SUMMARY OF THE INVENTION

In accordance with a first aspect of the invention, at least one of the above-identified needs is met by providing a gutter dumping assembly having a relatively simple design and configured to be used with existing gutters. The gutter may be selectively rotated from an initial, upright position to a downwardly-facing dumped position by driving a simple roof-mounted actuator system to engage a bracket assembly configured to receive and retain a portion of the gutter. Similarly, the gutter dumping assembly may selectively rotate the gutter back to its upright position after the contents have been dumped or otherwise cleaned out.

The gutter dumping assembly may include a bracket assembly mounted to a dwelling and configured to receive and retain a gutter. The bracket assembly and gutter are rotatable and rotate from an initial, upright position, to an over-center position at which point the gutter falls to a dumped position under only the force of gravity. An actuator may provide for rotating the bracket and gutter. The actuator may be manually or power operable. If desired, for longer gutter sections, more than one actuator may be employed. In such assemblies, a support member may be provided to link the bracket assemblies to one another for simultaneous rotation thereof.

The bracket assembly may comprise a first bracket rigidly mounted to the dwelling and a second bracket hingedly mounted to the first bracket. The second bracket is operably engaged by the actuator to cause rotation of the bracket assembly and gutter. Further, the second bracket may comprise a lower leg coupled to a downwardly-angled upper leg. The upper leg further includes a retainer configured to receive and retain a flange of the gutter therebetween.

The actuator assembly may be actuated manually or, alternatively, may comprise a motor configured to selectively drive the actuator assembly to move the gutter from the upright position to the dumped position or from the dumped position to the upright position.

In one embodiment of the motor-driven version, the motor moves with the gutter and drives a pinion, and further comprises a rack that is mounted on the building. The rack is operatively engaged by the pinion to drive the second bracket to pivot relative to the first bracket. The rack may be formed in a cantilevered bar extending from the building, and wherein the pinion is configured to travel along the rack from a first position corresponding to the initial upright position of the gutter to a second position corresponding to the over-center position of the gutter, wherein the second position is located outwardly with respect to the first position, and wherein the gutter is free to fall by gravity once it reaches the over-center position. A strap may be coupled between the motor and the building so as to unwind from the motor as the second bracket pivots away from the front bracket to limit a falling rate of the gutter once it reaches the over-center position.

In another embodiment of the motor-driven version, the motor is mounted on a roof of the building. In this case the actuator assembly further comprises, an actuator bar that is driven by the motor to extend and retract, a strap coupled to the actuator bar and extendible therefrom, and a kicker bracket coupled to the strap and the second bracket. Driving of the actuator bar causes the strap to extend therefrom and causes the kicker bracket to rotate along with the second bracket and gutter.

In yet another aspect of the present invention, a method of rotating a gutter from an upright position to a downwardly facing position to allow for dumping or otherwise cleaning out the gutter includes driving a roof-mounted actuator assembly so as to operably engage a bracket assembly configured to retain the gutter thereby rotating the bracket and gutter to a over-center position. Once reaching the over-center position, the bracket assembly and gutter may freely fall to a downwardly facing position under the force of gravity. Accordingly, the contents of the gutter are dumped or otherwise easily manually removed therefrom. The gutter dumping assembly may likewise rotate the gutter back to its initial upright position.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

A gutter dumping assembly constructed in accordance with a first embodiment of the invention is described below in connection with a standard gutter assembly for a dwelling. It should be understood that the illustrated assembly and others constructed in accordance with the invention could be used with other such gutter systems for buildings including those with substantially flat roofs. In addition, the gutter dumping assembly constructed in accordance with this invention could be used with custom-made gutters.

Figure 1:
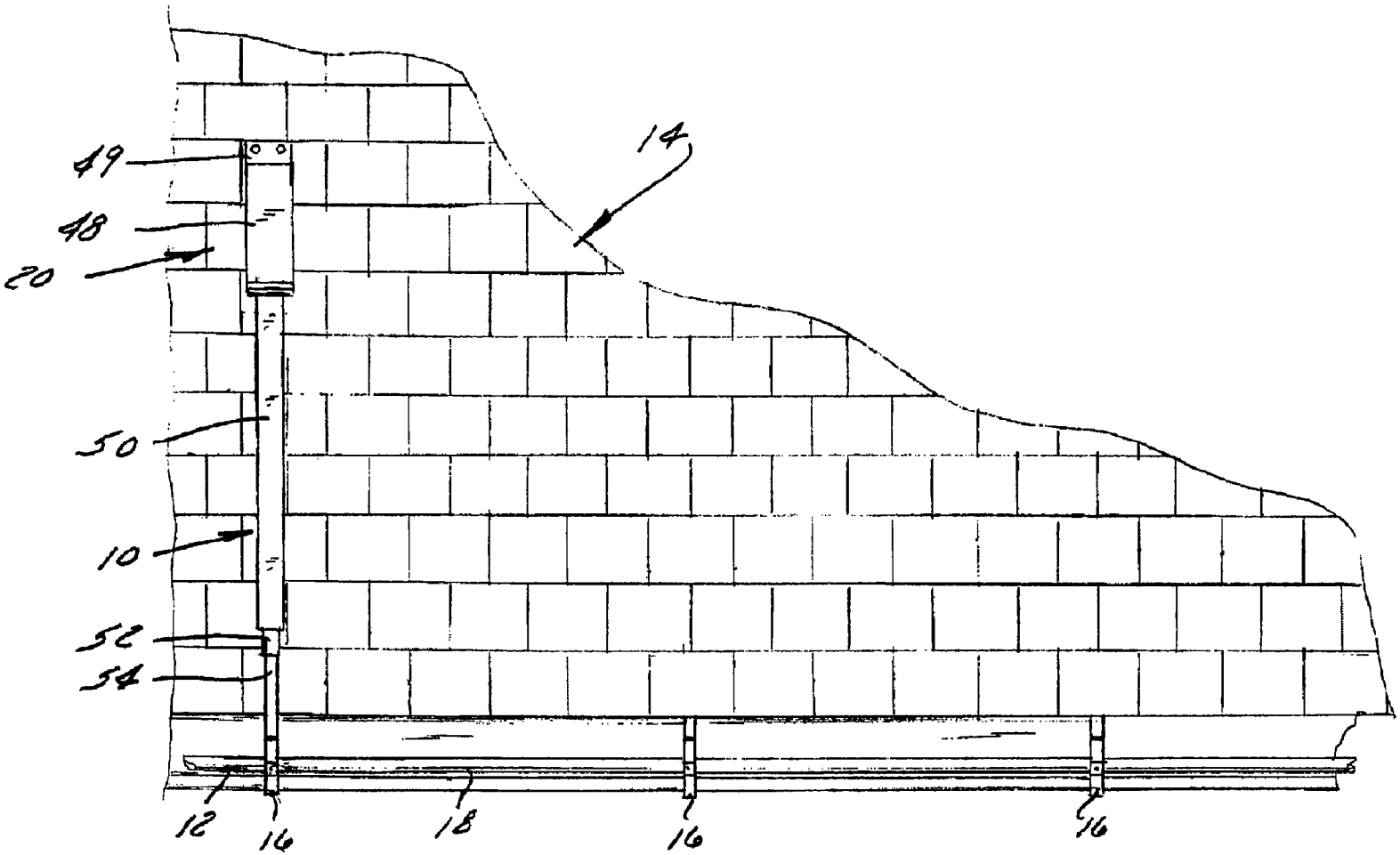
FIG. 1 is a top plan view of a gutter equipped with a gutter dumping assembly according to a first embodiment of the present invention.
Figure 2:
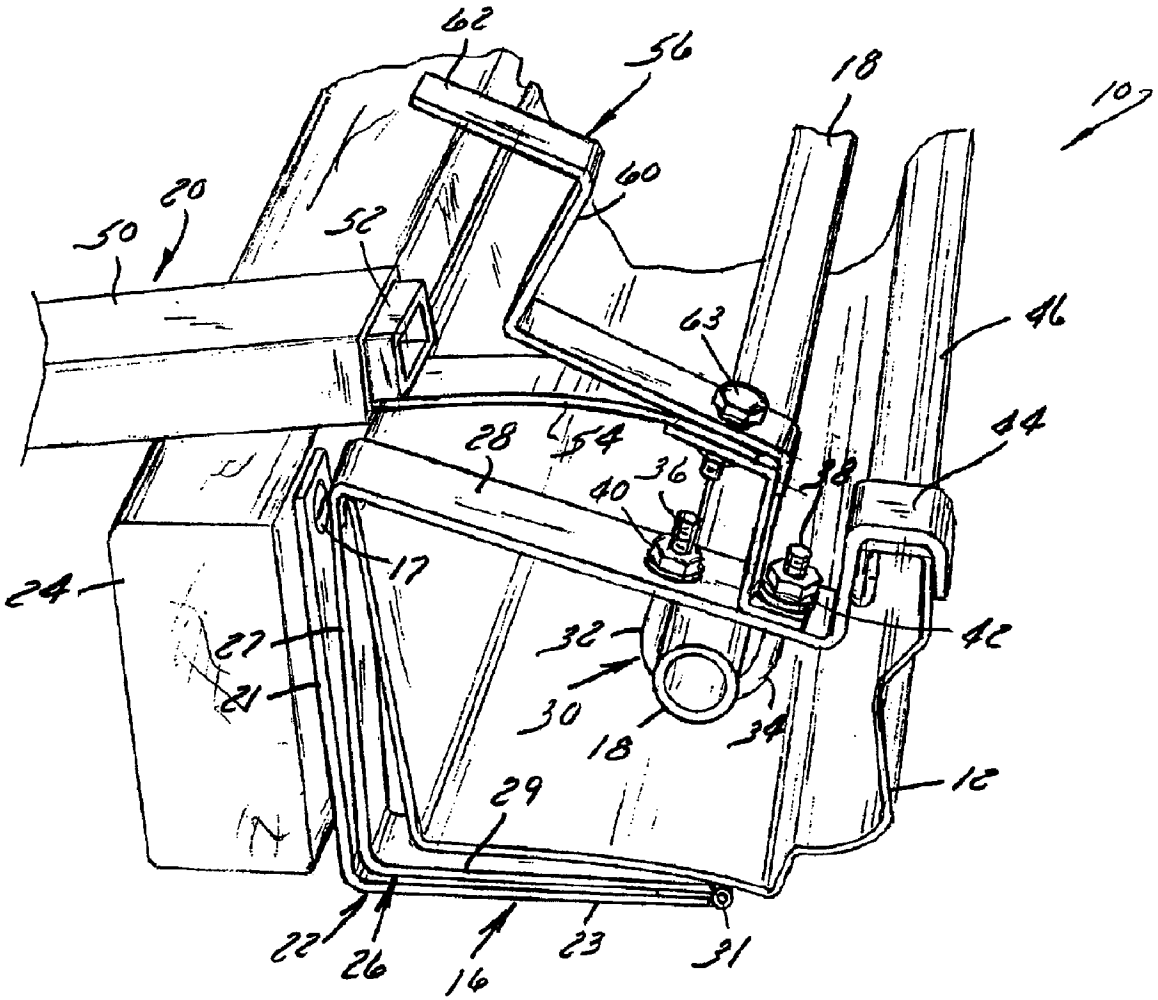
FIG. 2 is a perspective view of a portion of the gutter dumping assembly of FIG. 1.

Referring initially to FIGS. 1 and 2, a gutter dumping assembly 10 for selectively dumping a standard gutter 12 and returning the gutter 12 to its initial position is coupled to a gutter 12 on the roof 14 of a dwelling. The gutter dumping assembly 10 includes a plurality of spaced bracket assemblies 16 that support a rigid support tube 18. The gutter dumping assembly 10 also includes at least one roof-mounted actuator assembly 20. The bracket assemblies 16 are set at a spacing of twenty feet in this embodiment, but considerably smaller or larger spacings are envisioned. Preferably, one gutter dumping assembly 10 is required for each 20-foot section of gutter 12. As such, the gutter dumping assembly 10 of the present invention may comprise a plurality of rigid support tubes 18 and a corresponding number of actuator assemblies 20 for gutters 12 that are longer than twenty feet.

Figure 4:
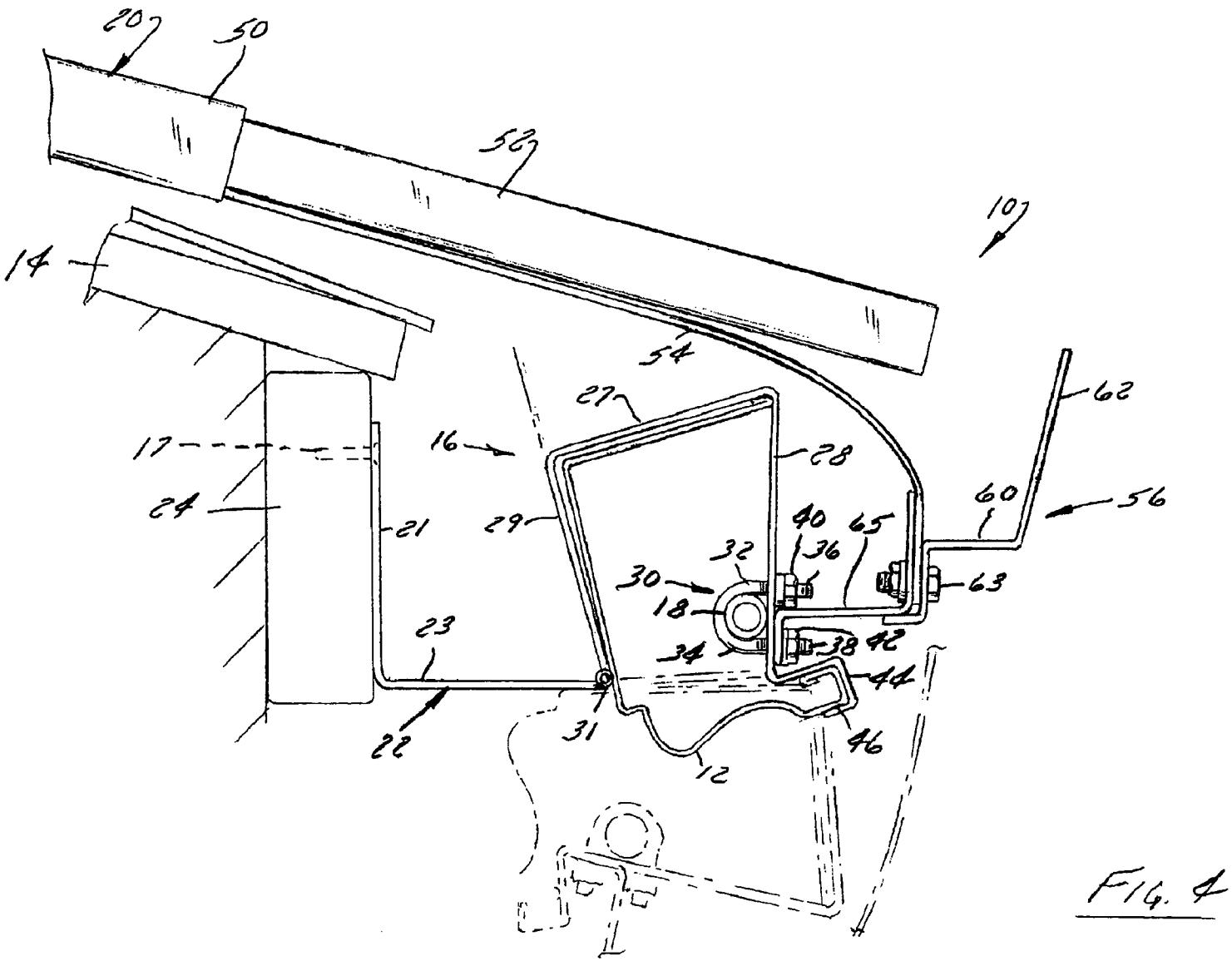
FIG. 4 is an end elevation view of the gutter dumping assembly of FIGS. 1-3B, showing the rotation of the gutter dumping assembly rotated from its initial upright position and a downwardly facing dumped position in shadow.

Referring to FIG. 4, each bracket assembly 16 preferably comprises an L-bracket 22 rigidly mounted to a fascia 24 or similar structure on the roof 14 by way of one or more fastener 17 such as a bolt or screw. A C-bracket 26 is hingedly coupled to L-bracket 22 and configured to be movable from a first position wherein the C-bracket pulls the gutter 12 upright to a dumped position on which the C-bracket 26 swings downwardly as much as 180 degrees. The C-bracket 26 includes an upper leg 28 that is preferably angled downwardly such that the rigid support tube 18 is hidden in gutter 12. The inclination of the upper leg 28 also directs water on the bracket 26 into the gutter so that it does not run off the front or back of the gutter. C-bracket 26 additionally includes a central leg 27 and a lower leg 29. The central leg 27 is generally flush with a vertical leg 21 of the L-bracket 22 when the C-bracket 26 is in its normal upright position illustrated in FIG. 1. The lower leg 29 extends beneath the bottom surface of the gutter 12 and extends horizontally so as to be generally flush with a horizontal leg 23 of the L-bracket 22 when the C-bracket is in its normal upright position illustrated in FIG. 1. The outer end of the lower leg 29 is pivotally attached the outer end of the horizontal leg 23 of the L-Bracket 22 by a hinge 31.

Still referring to FIG. 4, upper leg 28 of C-bracket 26 further includes a fastener 30 coupled thereto for retaining a portion of support tube 18. Fastener 30 may comprise a U-shape having two ends 32 and 34 configured to be received by holes in upper leg 28. Preferably, each of ends 32 and 34 includes a threaded portion, 36 and 38 respectively, for receiving nuts 40 and 42 thereon. Nuts 40 and 42 are provided to secure U-bolt 30 such that support tube 18 is securely retained therein. Upper leg 28 further comprises a retainer 44 for receiving an upper flange 46 of gutter 12. Preferably, upper flange 46 of gutter 12 simply snaps in under retainer 44 for securing gutter 12 therein.

Figure 7:
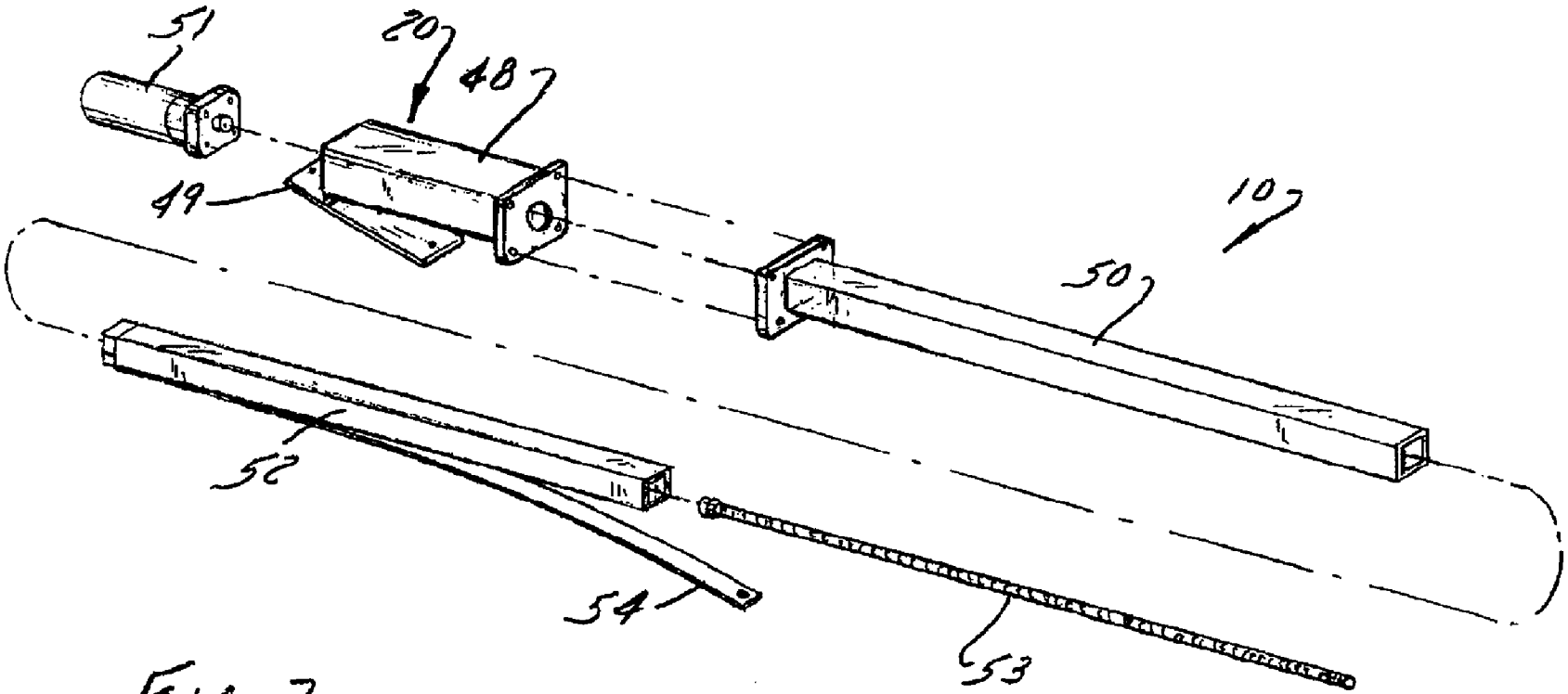
FIG. 7 is a partially exploded perspective view of the actuator assembly of the gutter dumping assembly of FIGS. 1-5.
Figure 8:
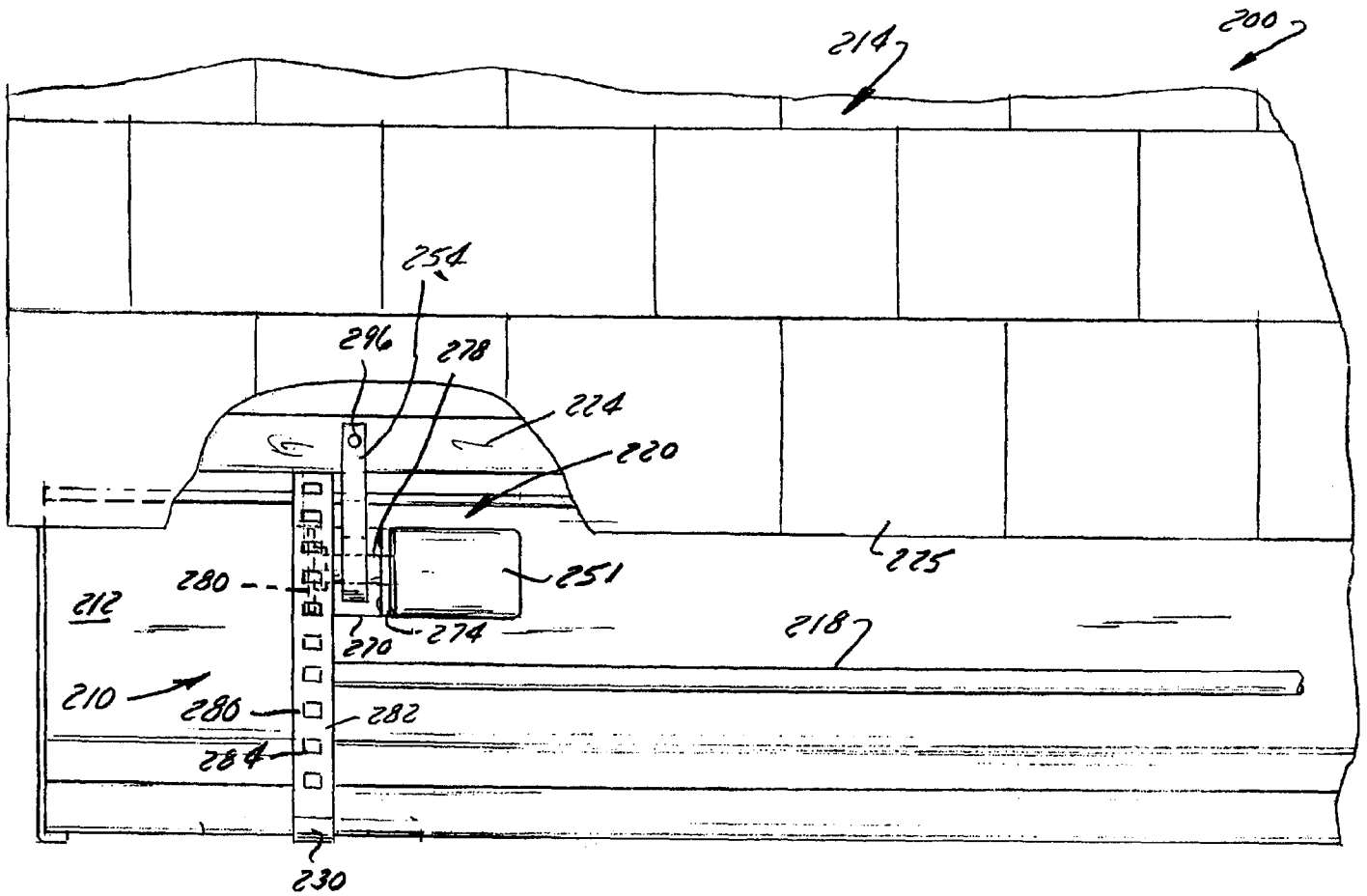
FIG. 8 is a top plan view of a gutter equipped with a gutter dumping assembly according to an alternative embodiment of the present invention.

Referring now to FIGS. 1, 2 and 7, actuator assembly 20 is configured to selectively dump the gutter 12 by driving the C-brackets 26 to pivot about their hinges 31. Unlike prior actuators that were mounted beneath the level of the roof and that were coupled to the gutters by complex chain drives, the actuator assembly 20 is preferably mounted on the roof 14 so as to be inconspicuous and is coupled to one or more of the brackets in a simple, robust, and flexible manner. Actuator assembly 20 is preferably linearly extendible rather than having a rotary output. In the illustrated embodiment, it preferably comprises an electric actuator, more preferably a screw jack mounted on the roof 14 of the dwelling and is configured to operably engage one or more of C-brackets 26. Preferably, actuator assembly 20 includes a base 48, a stationary outer tube 50 and an inner tube 52 telescopically housed within outer tube 50. The inner tube 52 is telescopically extendible from outer tube 50 during operation of the actuator assembly 20. The base 48 is mounted to the roof 14 of the dwelling screws or the like extending through a bracket 49 or similar such fastener. The outer tube 50 is hinged or otherwise pivotally attached to the bracket 49 so that the actuator assembly 20 can pivot as the inner tube 52 extends. This permits the outer end of the tube 52 to follow the motion of the kicker bracket, described in more detail below.

Actuator assembly 20 additionally includes a motor 51 configured to drive the actuator assembly 20. Preferably, actuator assembly 20 comprises a screw jack 53 housed in the inner tube 52. Screw jack 53 is preferably in communication with motor 51 such that motor 51 drives screw jack 53 to effectuate the telescopic movement of inner tube 52 from outer tube 50.

The gutter, or the attached actuator assembly 20, is coupled to the bracket 16 by a flexible structure such as a rope or a strap 54 fixed to the bottom of the inner tube 52 and coupled to a kicker bracket 56 by way of a bolt 63 or other such fastener. Kicker bracket 56 is bolted or otherwise fastened to upper leg 28 of C-bracket 26. Preferably, kicker bracket 56 is coupled to one of ends 36 and 38 of U-bolt 30 by way of a coupling bracket 65 disposed between the kicker bracket 56 and C-bracket 26 and retained by a nut 58 or similar such fastener. Kicker bracket 56 includes a vertical leg 60 and a generally forwardly extending horizontal leg 62 at an inward end of vertical leg 60. Vertical leg 60 serves as an abutment surface for engagement with inner tube 52 of actuator assembly 20. The forwardly extending horizontal leg 62 acts as a stop to prevent the inner tube 52 from pivoting upwardly and out of contact with the kicker bracket 56 upon actuation thereof. This permits the actuator assembly 20 to be used with widely varying roof pitches. In addition, a cover may be provided for the actuator assembly 20 so as to make the assembly more aesthetically pleasing.

Figure 3A:
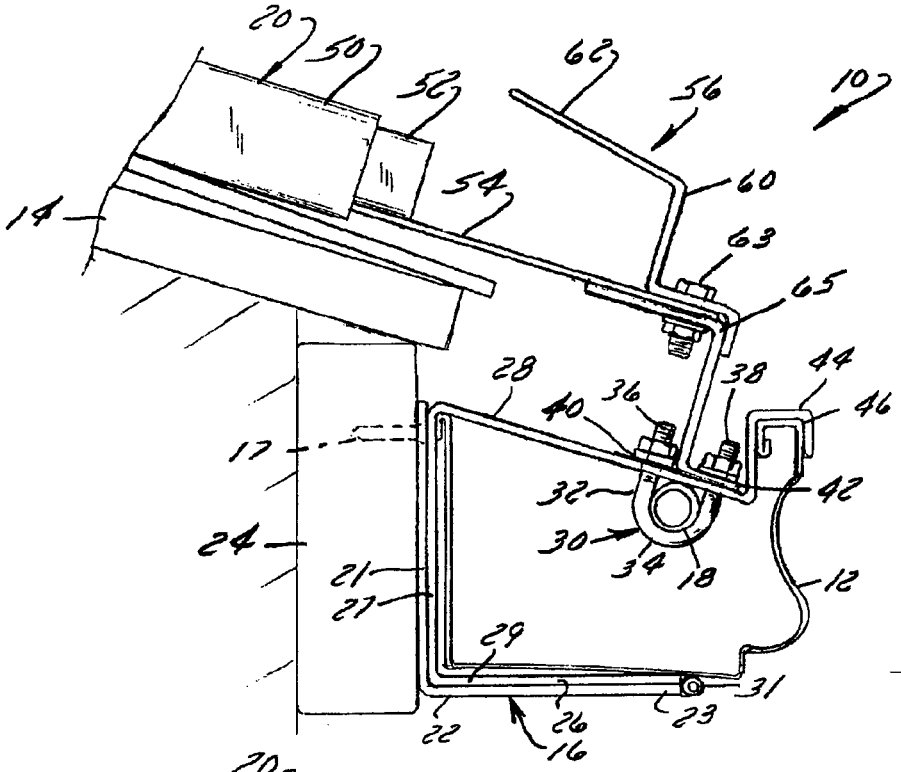
FIG. 3A is an end elevation view of the gutter dumping assembly of FIGS. 1 and 2 in an initial upright position.
Figure 3B:
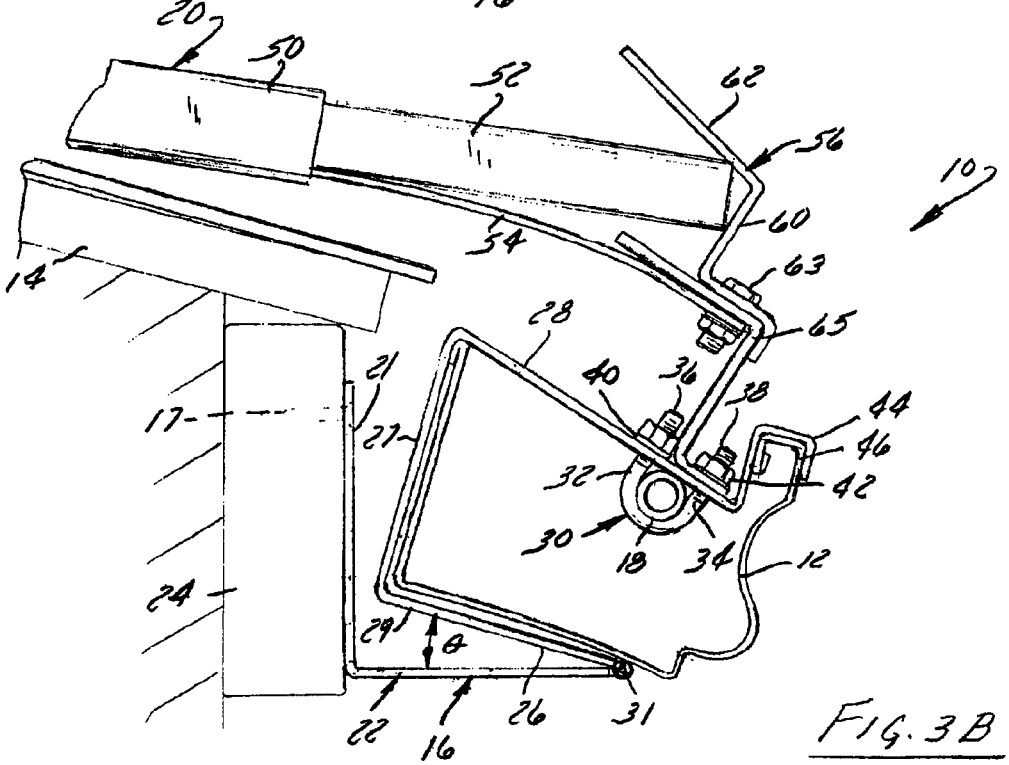
FIG. 3B is an end elevation view of the gutter dumping assembly of FIGS. 1-3A in a rotated, over-center position.

Turning now to FIGS. 3A and 3B, and initially to FIG. 3A, the gutter dumping assembly 10 of the present invention is shown just prior to actuation thereof. Accordingly, inner tube 52 and flexible strap 54 are shown in substantially non-extended positions. Referring now to FIG. 3B, the gutter dumping assembly is shown at a position just before reaching an over-center position wherein the gutter dumping assembly 10 and gutter 12 freely fall to a dumped position under the force of gravity. As shown in FIG. 3B, inner tube 52 and flexible strap 54 of actuator assembly 20 are shown partially extended from outer tube 50. The driving of the inner tube 52 from the outer tube 50 causes the strap 54 to flex, and the inner tube 52 continues to move outwardly until it engages the vertical leg 60 of kicker bracket 56. Continued motion of the inner tube 52 forces the kicker bracket 56 forward. The driving of the kicker bracket 56 serves to likewise drive the C-bracket 26 of bracket assembly 16 to pivot or otherwise hinge about a horizontal axis. As such, the gutter, which is retained by C-bracket 26 is likewise rotated about a horizontal axis.

The driving of the actuator assembly 20 causes the bracket assembly 16 to pivot the gutter 12 about an angle, θ, wherein the assembly and gutter reaches an over-center position. Preferably θ is about fifteen degrees. Once reaching the over-center position, the gutter 12 is free to fully rotate to a downwardly-facing position wherein the contents therein may be dumped or more easily manually removed by an operator. The rate at which the gutter 12 falls is controlled by the flexible strap 54 to the rate of extension of the inner tube 52.

Further, if the gutter 12 engages an obstruction such as a downspout during rotation, it simply rests against the obstruction. Further extension of the inner tube 52 simply results in imposing slack in the flexible strap 54. This is particularly advantageous over other actuators for gutter dumping systems that positively drive the gutter to its dump position.

Figure 5:
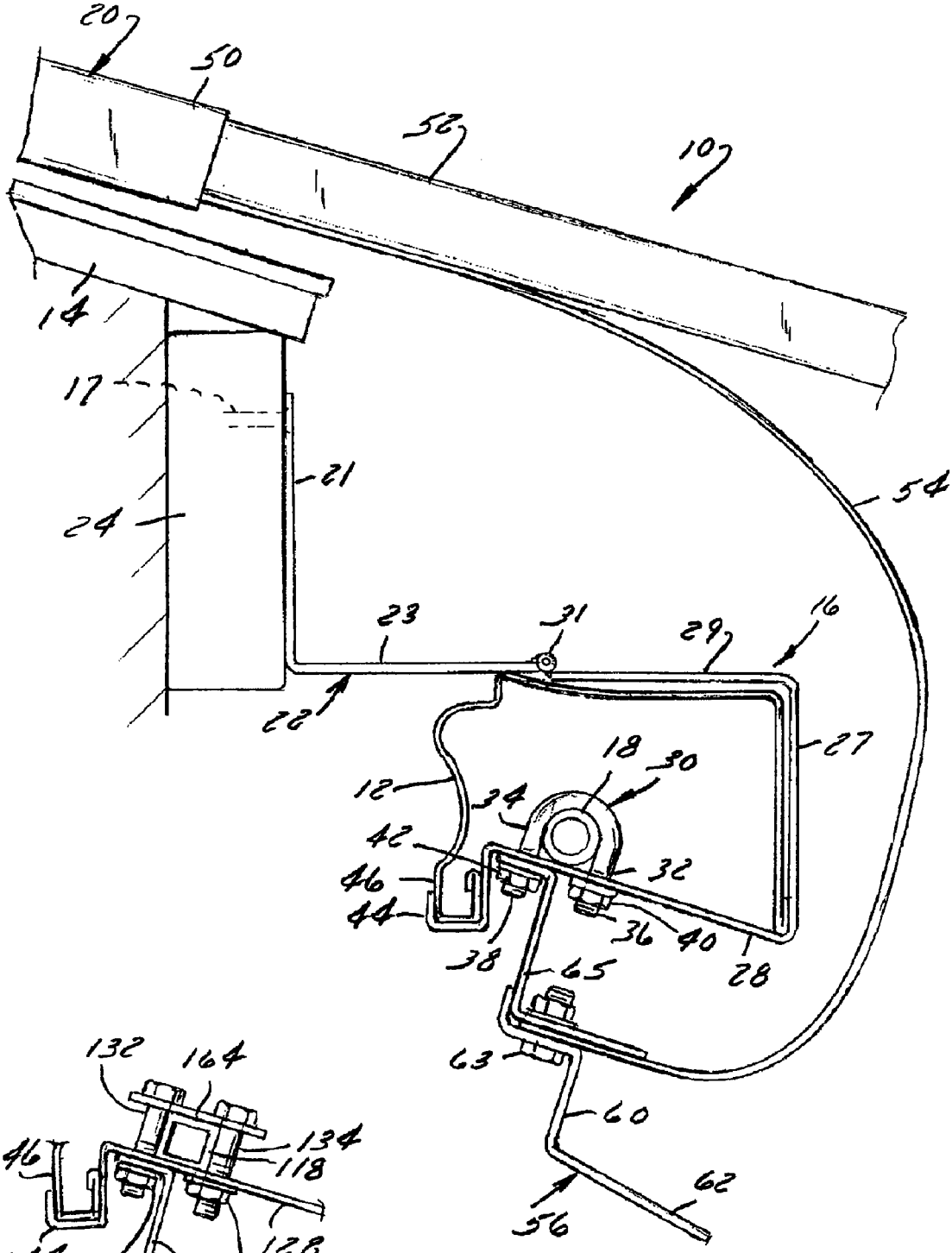
FIG. 5 is an end elevation view of the gutter dumping assembly of FIGS. 1-4 in the downwardly-facing dumped position.

Turning now to FIGS. 4 and 5, and initially to FIG. 4, gutter dumping assembly 10 is shown having rotated the gutter 12 and C-bracket 26 to the over-center position wherein the assembly 10 and gutter 12 freely fall to a dumped position under gravitation force. The downwardly-facing dumped position is shown in shadow in FIG. 4 wherein the gutter 12 is facing directly down at the ground. FIG. 5 shows the gutter 12 and gutter dumping assembly 10 of FIG. 4 in the downwardly-facing dumped position.

The gutter 12 can be returned to its upright position simply by reversing the direction of the motor 51 of actuator assembly 20 to retract the inner tube of the actuator assembly 20 into the outer tube 50, hence causing the strap 54 to retract and pivot the c-bracket 26 counterclockwise about hinge 31 until the gutter 12 returns to its normal position of FIGS. 1 and 2A. In addition, the gutter 12 may be kept in the downwardly-facing dumped position during the winter months in colder climates to prevent the build-up of ice dams.

Figure 6:
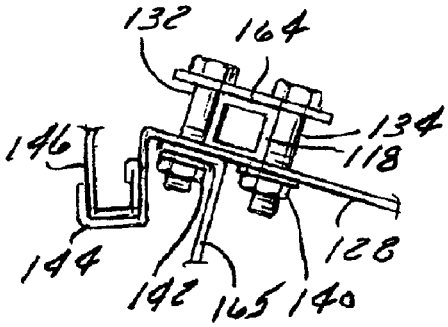
FIG. 6 is an end elevation view of a portion of the gutter dumping assembly of a second embodiment.

Referring now to FIG. 6, an alternative embodiment of the present invention includes a support member 118 having a generally rectangular cross-section. Support member 118 is retained by a pair of threaded bolts 132 and 134. Bolts 132 and 134 are inserted through a pair of holes in upper leg 128 as in the prior embodiment. A pair of nuts 140 and 142 or similar such fasteners are provided to secure the bolts 132 and 134 in the holes in upper leg 128. Support member 118 is restrained from lateral movement by bolts 132 and 134. Upper leg 128 prevents support member 118 from slipping upwardly (when at rest) or downwardly (when in dumped position). In addition, a retaining bar 164 is provided for supporting the support member 118 when the gutter dumping assembly 10 is in the initial, upright position. Retaining bar 164 preferably includes a pair of holes for receiving the threaded ends of bolts 132 and 134. The alternative embodiment of the present invention is advantageous in that support member 118 is not capable of being overtightened by twisting thereof. Accordingly, support member 118 is not crimped or otherwise damaged during installation.

In another embodiment of the present invention, the roof mounted actuator 16 may be operated manually rather than by a motor. For example, it may be operably coupled with a manual crank assembly (not shown) for driving actuation thereof. In this embodiment, the crank assembly is positioned in communication with the roof-mounted actuator such that a user can use a hook or other such device to grasp the crank assembly to turn the crank in a first direction to selectively extend the roof mounted actuator and in a second direction to retract the roof mounted actuator. The operation of the present embodiment remains the same as the roof-mounted actuator 16 of the first embodiment. That is, it is configured to operably engage the C-bracket 26 to drive rotation of the assembly 10 to dump the gutter 12.

Referring now to FIGS. 8-13, an alternative embodiment of the motorized rotating gutter assembly 210 is illustrated. It is mounted on a building 200 having roof 214 and a soffit 224 underlying an overhang 225 of the roof 214. The present embodiment replaces the roof-mounted actuator assembly 20 of the first embodiment with a rack and pinion assembly 220 and further includes an electric motor assembly at least partially mounted within the gutter 212, thereby providing a less intrusive, aesthetically pleasing, and relatively simple design. The electric motor assembly of this embodiment includes a vertical bracket 274 and an electric motor mounted to the vertical bracket 274. The gutter 212 is moved to its over-center position by the rack and pinion assembly 220, which is driven by the motor 251.

Figure 10:
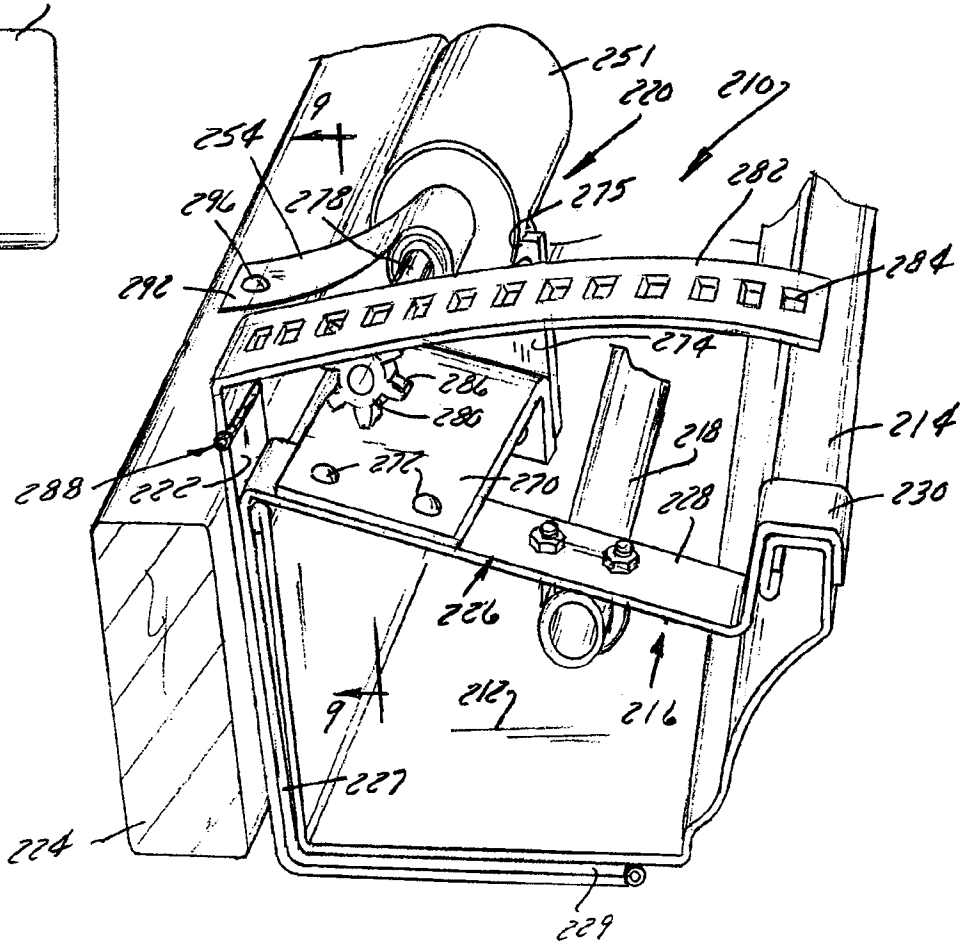
FIG. 10 is a perspective view of a portion of the gutter dumping assembly of FIGS. 8 and 9.
Figure 9:
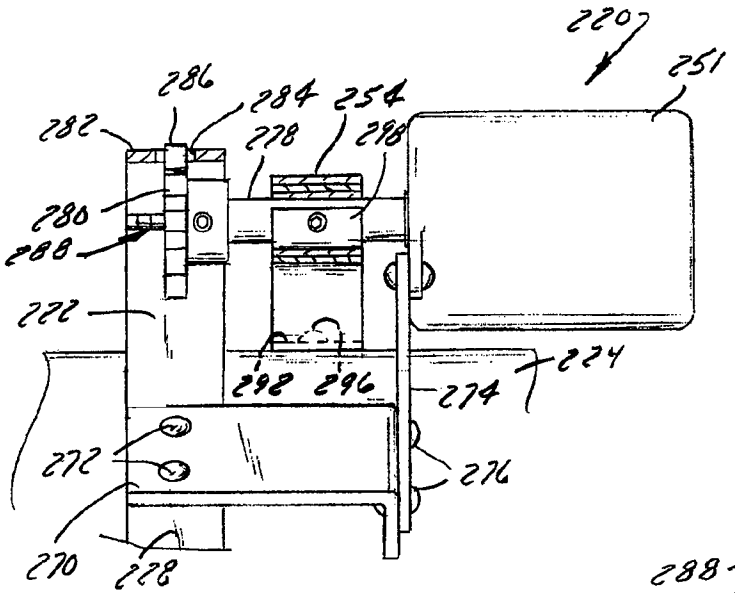
FIG. 9 is a top plan view of a portion of the gutter dumping assembly of FIG. 8.

Turning now to FIGS. 9 and 10, the present embodiment of the rotating gutter assembly 210 includes a plurality of spaced bracket assemblies 216 for securing the gutter 212 to the building. As in the first embodiment, the bracket assemblies may be coupled to one another by a rigid support tube 218 running the length of the assembly 220. Each bracket assembly 216 is substantially similar to that of the first embodiment of the present invention, and it includes a fixed L-bracket 222 mounted to the soffit 224 and a C-bracket 226 hingedly mounted to the L-bracket 222. The C-bracket 226 includes a central leg 227, a downwardly-angled upper leg positioned 228 for cooperating with the rack and pinion assembly 220 as will be described in detail below, and a lower leg 229 hingedly connected to the outer end of the horizontal leg of the L-bracket 222. The upper leg 228 terminates in a retainer 230 configured for securing the gutter 212 to the bracket assembly 216.

The rack and pinion assembly 220 is operably coupled to one of the bracket assemblies 216 by way of a first bracket 270, which is attached to the upper leg 228 of the C-bracket 226 by a pair of fasteners 272 as best seen in FIG. 10. First bracket 270 extends lengthwise of the gutter 212 from the C-bracket upper leg 228 to a front end that supports a second, vertical bracket 274 by a pair of fasteners 276. Motor 251 is retained in a groove 275 cut into the top of the second bracket and bolted to the top of the second bracket 274, hence obtaining a low profile wholly or partially within the gutter and remaining inconspicuous. Motor 251 comprises a reversible electric motor that may be activated from the ground using a remote switch and/or a transmitter. Motor 251 includes an output shaft 278 operably coupled to the pinion 280 of the rack and pinion assembly 220. The output shaft 278 is configured to drive the pinion 280 along a rack 282 of the rack and pinion assembly 220.

The rack 282 takes the form of a cantilevered bar that extends outwardly from an upper end of the soffit 224 in a shallow arc that generally matches the arc that the pinion 280 follows as the gutter dumps. The rack 282 has slots 284 formed through it that are engaged by teeth 286 on the periphery of the pinion 280. The cantilevered nature of the rack 282 allows it to flex somewhat so as allow considerable tolerance of pinion positioning while still ensuring a meshing relationship of the teeth 286 and slots 284. Still additional tolerance may, if desired by connecting pinion 282 to the underlying support by a hinge 288 that allows a limited degree of rack motion of, e.g., 5° to 15°. This additional tolerance ensures that the pinion will engage the outermost slot 284 in the rack 282 during the return stroke of the gutter assembly from its dumped position. In this embodiment, the hinge 288 is located between the bottom of a short vertical leg of the pinion 282 and an upper end of the L-bracket 222.

As in the previous embodiment, an extendible flexible structure such as a rope or, more preferably, a strap 254 is provided that controls the rate of fall after the gutter 212 moves past its over-center position and that can be retracted upon the return stroke to return a dumped gutter to its upwardly facing position. The 254 strap has an outer end 292 fixed to the soffit 224 or other portion of the structure by a fastener 296 an inner end 298 (FIG. 9) wound onto the shaft 278 adjacent the motor 251.

Figure 11:
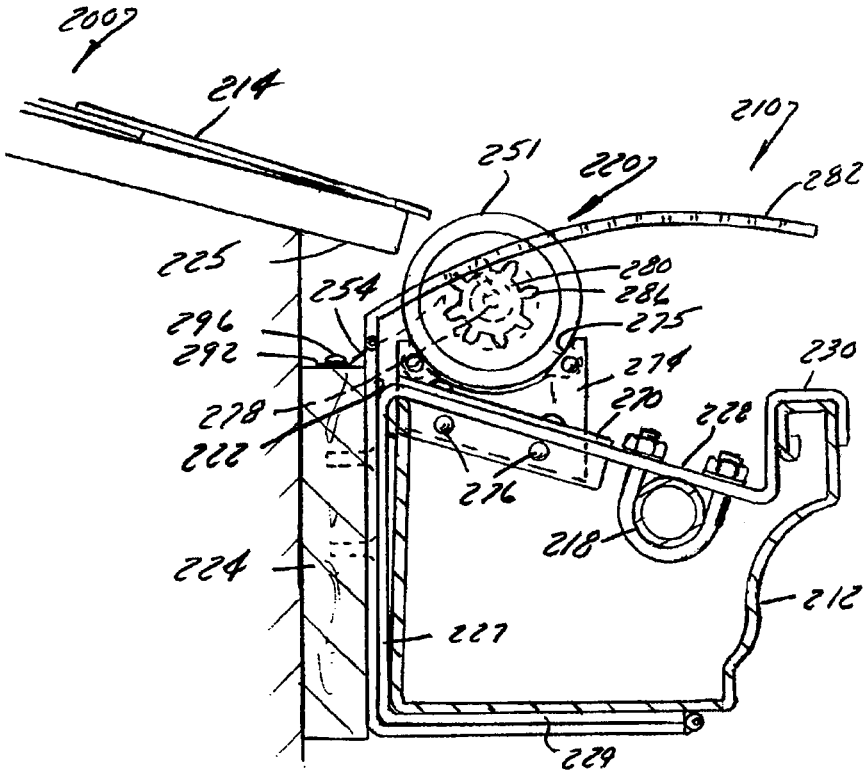
FIG. 11 is an end elevation view of the gutter dumping assembly of FIGS. 8-10 in an initial, upright position.
Figure 12:
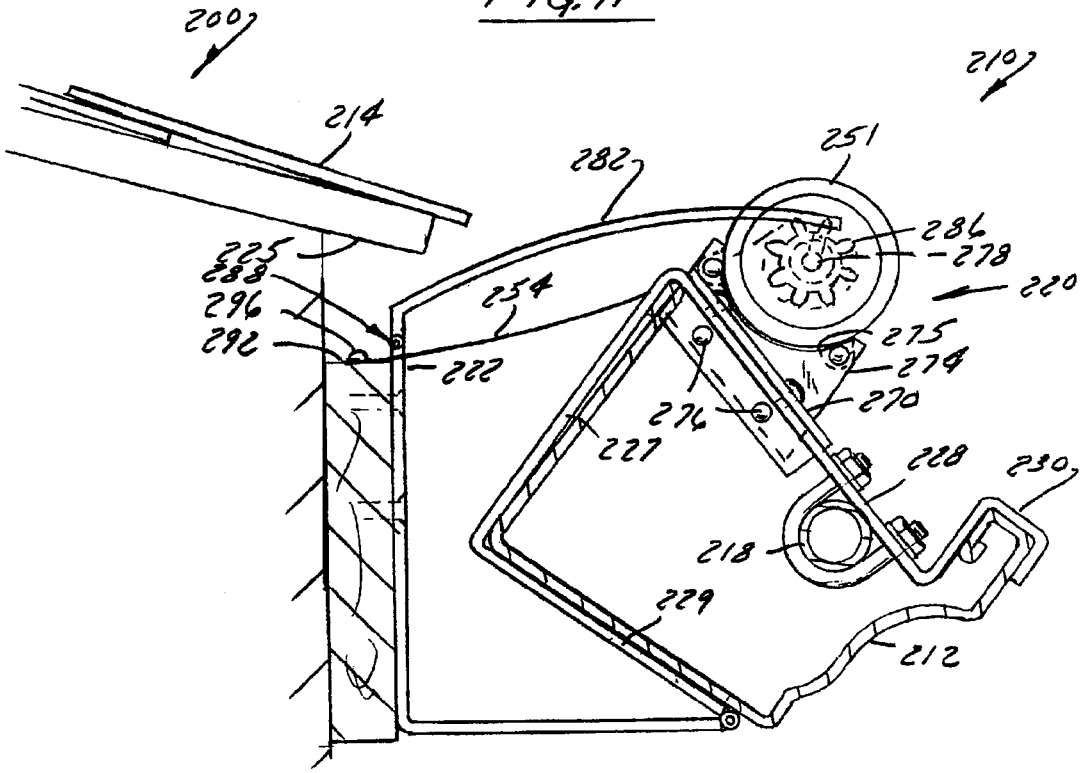
FIG. 12 is an end elevation view of the gutter dumping assembly of FIGS. 8-11 in a rotated, over-center position.
Figure 13:
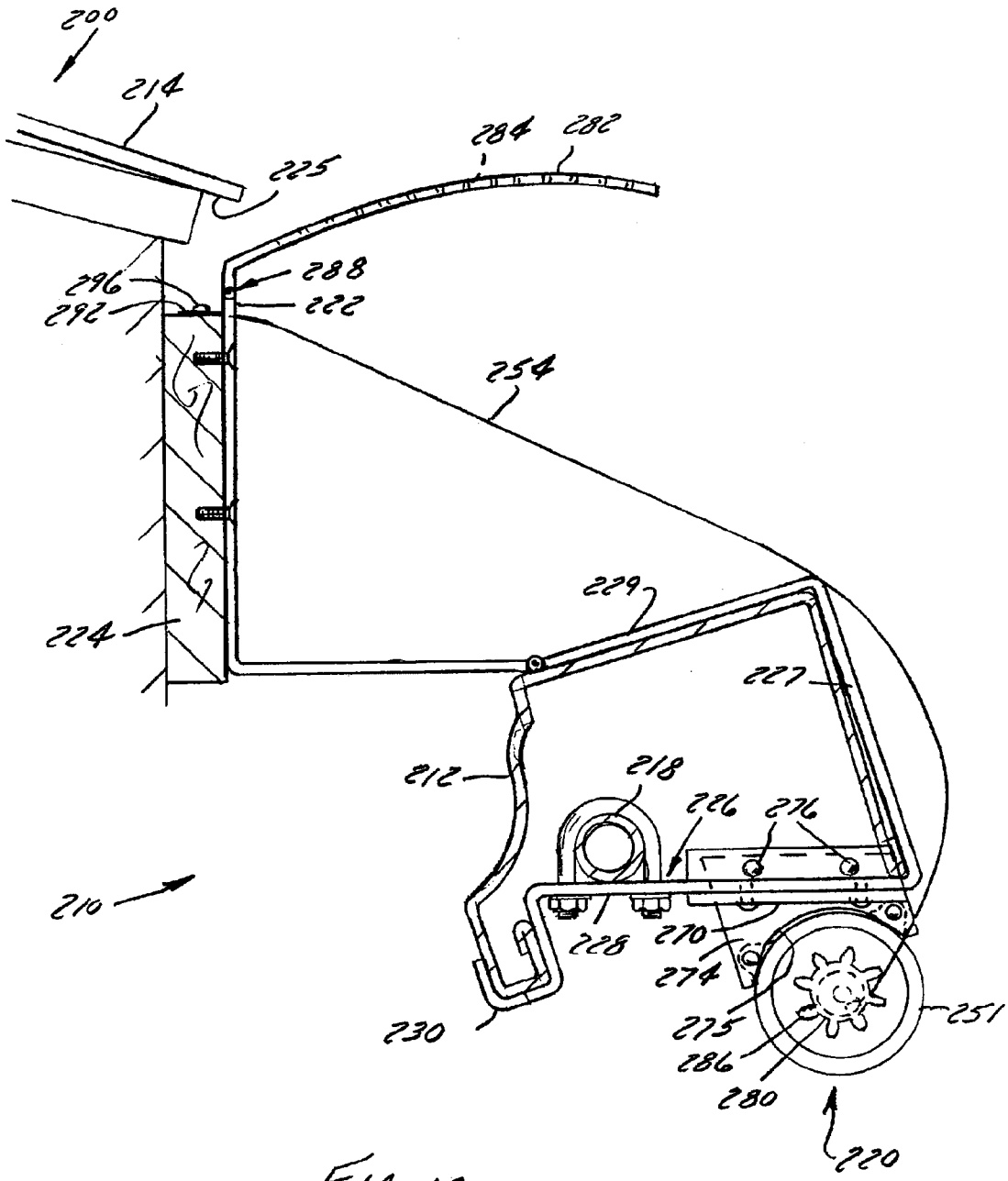
FIG. 13 is an end elevation view of the gutter dumping assembly of FIGS. 8-12, in the downwardly-facing dumped position.

Turning now to FIGS. 11-13, the operation of the present embodiment of the invention is illustrated. Referring initially to FIG. 11, the gutter 212 is shown in the initial, upwardly facing position. When it is desired to dump the contents of the gutter 212, the user engages the motor 251 to begin the driving of the gutter 212 from its upright position to a dumped position. As the motor 251 drives the output shaft 278, the pinion 280 is driven along the rack 282 thereby rotating the C-bracket 226 with respect to L-bracket 222. Referring now to FIG. 12, the gutter 212 is shown in an over-center position as the pinion 280 has reached the end of the rack 282. As in the previous embodiment, the over-center position is approximately 15 degrees. Turning now to FIG. 13, once the gutter 212 obtains the over-center position, the gutter 212 freely falls under gravity to a dumped position wherein the contents of the gutter 212 are dumped or may be easily removed by a user. The rate of the gutter's 212 fall is restrained by the flexible strap 254 to the rate of motor rotation. As in the previous embodiment, if the gutter 212 engages an obstruction such as a downspout as it falls, the gutter 212 simply rests against the obstruction.

To return the gutter 212 to its initial, upright position, the motor rotates in the opposite direction to wind the strap 254 back onto the shaft 278 until the gutter 212 again moves past its over-center position, whereupon the pinion 280 again engages the rack 282. Continued rotation of the motor 251 drives the pinion 280 along the rack 282 toward the soffit 224 of the building 200, thereby pivoting the C-bracket 226 back to its upwardly facing position of FIG. 11 in which the gutter assembly rests securely on the L-brackets 222.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

We claim:

1. A dumping assembly for a gutter comprising:

at least one bracket assembly configured to receive and retain the gutter and to be mounted to a building, wherein the bracket assembly includes a first, stationary bracket that is supported on the building and a second bracket that supports the gutter and that is pivotally connected to the first bracket;

an actuator assembly that operably engages the second bracket so as to drive the second bracket to pivot from a first, upright position to an over-center position such that the gutter thereafter falls to a dumped position under gravitational force, wherein the actuator assembly comprises an electric motor assembly that drives the second bracket to move relative to the first, stationary bracket and which is at least partially mounted within the gutter; and an extensible element that extends as the second bracket pivots away from the first bracket to limit a falling rate of the gutter after the gutter reaches the over-center position and that retracts upon movement of the gutter to an upright position.

2. The dumping assembly of claim 1, further comprising a plurality of additional bracket assembles spaced from one another and from the first bracket assembly along a length of the gutter.

3. The dumping assembly of claim 1, wherein the first bracket comprises an L-bracket and the second bracket comprises a C-bracket.

4. The dumping assembly of claim 3, wherein the second bracket includes, (a) an upper leg having an inner end and an outer end, the outer end angled downwardly;

(b) a lower leg coupled to the upper leg; and (c) a retainer disposed on the outer end of the upper leg and configured to receive and retain the gutter.

5. The dumping assembly of claim 1, wherein the electric motor assembly is configured to move with the gutter and drive a pinion, and further comprising a rack that is mounted on the building and that is operatively engaged by the pinion to drive the second bracket to pivot relative to the first bracket.

6. The dumping assembly of claim 5, wherein the rack is formed in a cantilevered bar extending from the building, and wherein the pinion is configured to travel along the rack from a first position corresponding to the initial upright position of the gutter to a second position corresponding to the over-center position of the gutter, wherein the second position is located outwardly with respect to the first position, and wherein the gutter is free to fall by gravity once it reaches the over-center position.

7. The dumping assembly of claim 1, wherein the extensible element comprises a strap.

8. The dumping assembly of claim 7, wherein the strap selectively winds onto the motor to pivot second bracket pivots upwardly from the dumped position thereof.

9. A dumping assembly for a gutter comprising:

a bracket assembly including a first, stationary bracket that is supported on a building, and a second bracket that supports the gutter and that is pivotally connected to the first bracket; and an actuator assembly that operably engage the second bracket so as to drive the second bracket to pivot from a first, upright position to an over-center position such that the gutter falls to a dumped position under gravitational force, the actuator assembly comprising a motor that moves with the gutter and that drives a pinion, a rack that is mounted on the building and that is operatively engaged by the pinion to drive the second bracket to pivot relative to the first bracket through at least a portion of the range of second bracket pivoting, and a strap that is coupled between the motor and the building and that unwinds from the motor as the second bracket pivots away from the first bracket to limit a falling rate of the gutter after it reaches the over-center position.

10. A gutter system comprising:

a gutter that defines a pair of opposed sides, a pair of ends, a bottom and an upwardly open top;

a gutter dumping assembly coupled to the gutter, the gutter dumping assembly comprising, a plurality of bracket assemblies, each of the bracket assemblies including a fixed bracket that is mounted on a building and a movable bracket that is movably supported on the fixed bracket and that supports the gutter; and an actuator assembly that operably engages at least one of movable brackets to pivot the movable brackets and the gutter with respect to the building to an over-center position, wherein the actuator assembly includes an electric motor assembly configured to drive at least one of the movable brackets relative to at least one of the fixed bracket, and wherein the electric motor assembly is mounted at least partially within the gutter, and wherein, upon reaching the over-center position, the movable brackets and gutter fall to a dumped position under gravitational force at a rate that is controlled by an extensible element that is coupled to the actuator assembly.

11. The gutter system of claim 10, wherein the gutter dumping assembly further comprises a support member that extends lengthwise of the gutter and that interconnects the movable brackets, and wherein each of the movable brackets includes a downwardly angled upper leg and a lower leg coupled to the upper leg, wherein the upper leg is configured to retain the support member in the gutter so as to conceal the support member from view, and wherein the movable bracket is hingedly movable with respect to the stationary bracket.

12. The gutter system of claim 10, wherein the extensible element comprises a strap that extends and retracts under power of an electric motor of the electric motor assembly.

13. A gutter system comprising:

a gutter that defines a pair of opposed sides, a pair of ends, a bottom and an upwardly open top;

a gutter dumping assembly coupled to the gutter, the gutter dumping assembly comprising, a plurality of bracket assemblies, each of the bracket assemblies including a fixed bracket that is mounted on a building and a movable bracket that is movably supported on the fixed bracket and that supports the gutter; and an actuator assembly that operably engages at least one of movable brackets to pivot the movable brackets and the gutter with respect to the building to an over-center position, wherein, upon reaching the over-center position, the movable brackets and gutter fall to a dumped position under gravitational force at a rate that is controlled by an extensible element that is coupled to the actuator assembly, and wherein the actuator assembly comprises an electric motor assembly that drives the movable brackets to move relative to the fixed brackets, wherein the electric motor assembly is mounted at least partially in the gutter and moves as the gutter dumps.

14. A method of dumping a gutter attached to a building to clear debris collected therein, the gutter being coupled to a gutter dumping assembly having an actuator assembly, the method comprising the step of:

operating the actuator assembly to engage a bracket assembly so as to positively drive the gutter to an over-center position, whereafter the gutter rotates to a dumped position under gravitational force at a rate that is controlled by an extensible element that is coupled to the actuator assembly and that extends upon movement of the gutter to the dumped position and that retracts upon movement of the gutter to the upright position;

wherein the actuator assembly includes an electric motor assembly mounted at least partially within the gutter.

15. The method of claim 14, wherein the electric motor assembly comprises a bracket coupled to the gutter and an electric motor mounted to the bracket, and wherein the electric motor assembly is movable with the gutter.

16. A method of dumping a gutter attached to a building to clear debris collected therein, the gutter being coupled to a gutter dumping assembly having an actuator assembly, the method comprising the step of:

operating the actuator assembly to positively drive the gutter to an over-center position, whereafter the gutter rotates to a dumped position under gravitational force at a rate that is controlled by an extensible element that is coupled to the actuator assembly, wherein the operating step is performed via an electric motor assembly, and wherein the electric motor assembly is located at least partially in the gutter and moves with the gutter.

17. A dumping assembly for a gutter comprising:

at least one bracket assembly configured to receive and retain the gutter and to be mounted to a building; and an actuator assembly that operably engages the second bracket so as to drive the second bracket to pivot from a first, upright position to an over-center position such that the gutter thereafter falls to a dumped position under gravitational force, wherein the actuator assembly includes an electric motor assembly that is supported by the bracket assembly and that is located at least partially within the gutter.

* * * * *